United States Patent [19]

Beckerer, Jr.

[11] Patent Number: 4,729,584

[45] Date of Patent: Mar. 8, 1988

[54] BOAT HATCH OR WINDOW CONSTRUCTION

[76] Inventor: Frank S. Beckerer, Jr., 40 Dock Rd., Milford, Conn. 06460

[21] Appl. No.: 911,715

[22] Filed: Sep. 26, 1986

[51] Int. Cl.[4] ..... E05C 19/00

[52] U.S. Cl. ..... 292/257; 292/256.75

[58] Field of Search ..... 292/257, 113, 247, 256.75; 52/209

[56] References Cited

U.S. PATENT DOCUMENTS

| | | | |
|---|---|---|---|
| 416,359 | 12/1889 | Cooley | 292/257 |
| 736,772 | 8/1903 | Petersen | 292/257 X |
| 3,361,465 | 1/1968 | Dobbs | 292/257 |
| 3,514,009 | 5/1970 | Emery et al. | 292/257 X |
| 4,363,350 | 12/1982 | Beckerer | 52/209 X |
| 4,388,873 | 6/1983 | Carleton et al. | 292/257 X |

*Primary Examiner*—Richard E. Moore

*Attorney, Agent, or Firm*—H. Gibner Lehmann; K. Gibner Lehmann

[57] ABSTRACT

There is disclosed a boat window construction having a window frame including a spigot defining a window opening, and a window pane hingedly connected to the window frame and adapted to be moved between open and closed positions. A tie rod is swivel mounted on the frame and can swing toward and away from an abutment shoulder on the window pane. A cross pin is carried on the tie rod, and a camming finger piece is turnable on the pin about an axis perpendicular to the tie rod. The finger piece has camming surfaces that can selectively engage the abutment shoulder on the window pane. The camming surfaces are located on different radii with respect to the axis of the cross pin. The arrangement is such that after the window pane is moved toward its closed position, the finger piece and tie rod can be shifted until one of the camming surfaces of the piece engages the abutment shoulder. Thereafter the finger piece can be turned about the axis of the cross pin so as to disengage the one camming surface from the abutment shoulder and bring the second camming surface into engagement therewith, and thus draw the window pane toward a sealing position with respect to the window frame by a cam action.

21 Claims, 9 Drawing Figures

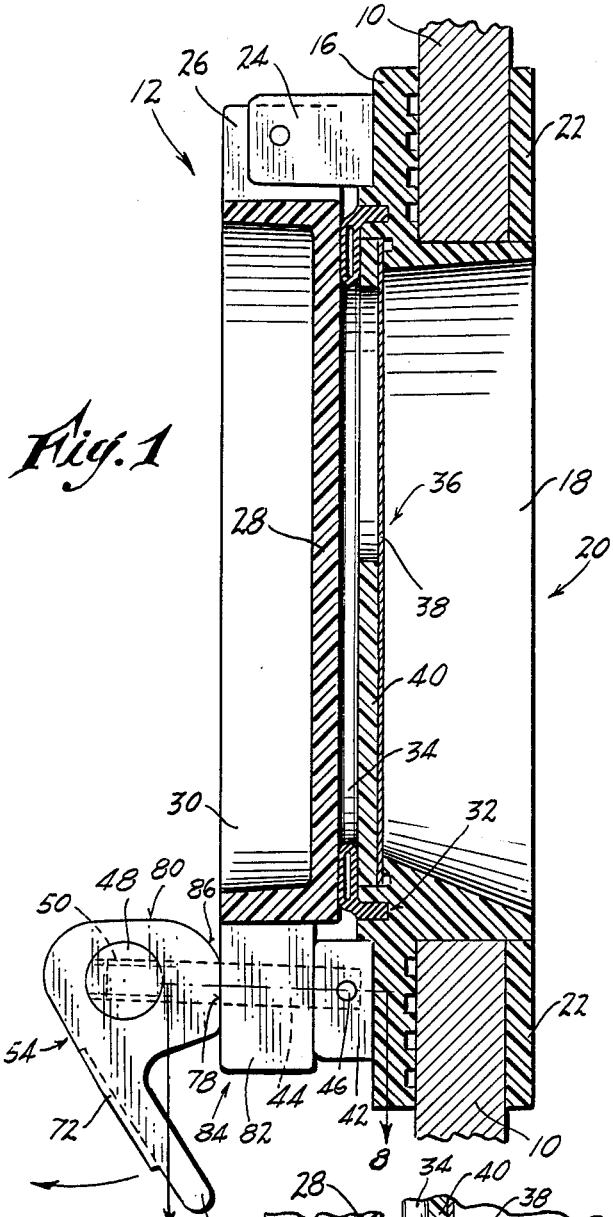
Fig. 1
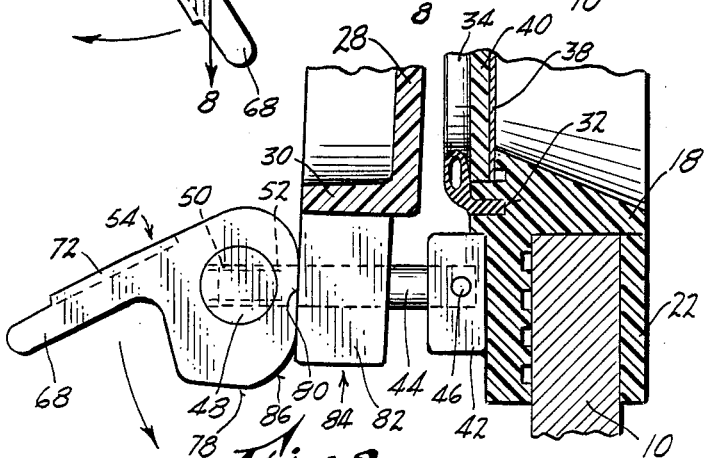
Fig. 2
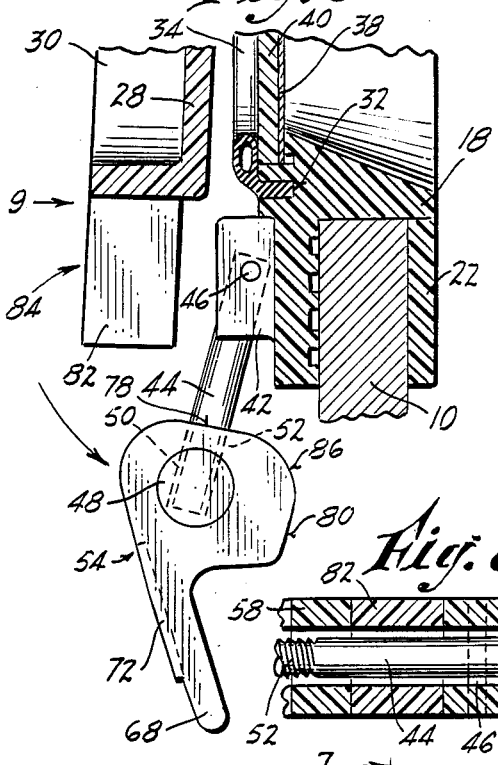
Fig. 3
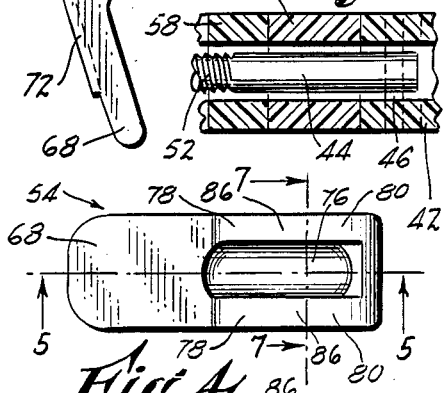
Fig. 8
Fig. 4
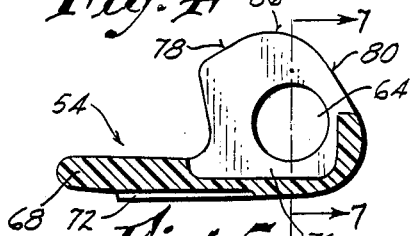
Fig. 5
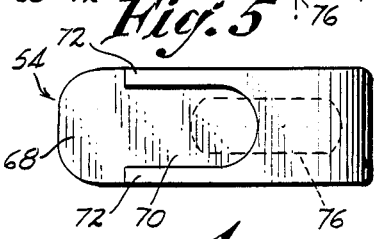
Fig. 6
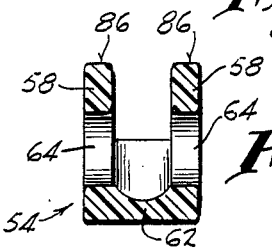
Fig. 7

BOAT HATCH OR WINDOW CONSTRUCTION

BACKGROUND

This invention relates generally to boat windows, hatches and the like, and more particularly to devices of this type wherein a window pane or hatch cover is hingedly connected to a window or hatch frame, and wherein the pane or cover has one or more fork-like shoulders that receive swivel pins carried on the frame so as to permit the pane or cover to be drawn toward a sealing position by means of knobs which are carried on the pins.

A typical construction involving a boat window is illustrated in U.S. Pat. No. 4,363,350 dated Dec. 14, 1982, issued to Frank S. Beckerer, and entitled SELF-DRAINING BOAT WINDOW.

This patented construction involves a window pane having projections 60, 62 and threaded swivel pins 52 carrying manually-engageable knobs 58. With the window closed and with the left pin 52 of FIG. 1 in the position illustrated, locking of the window pane is accomplished by swinging the pin upwardly to a position corresponding to that of the right pin 52 in this figure, and screwing the knob 58 down so as to draw the window pane against the window frame gasket, FIG. 4. Generally the knobs 58 were constituted of molded plastic, and embedded therein were threaded fasteners that engaged the threaded pins 52.

While this arrangement has been employed for many years and on numerous window installations, it has been found that opening and closing/locking multiple windows in this fashion represents a considerable total effort, and thus constitutes a distinct nuisance. When one considers that a typical boat can easily incorporate a dozen or more such units, with each having two or more fasteners, it can be seen that the opening or closing and locking of a series of such windows is not convenient. The problem is aggravated by the fact that all too often, many windows had to be closed in succession, as where sudden wind shifts created splashing, or where rain showers began abruptly or without warning. Especially with sailboats, the arrival of a storm necessitates immediate action involving tending of the sails so as to avoid possible damage thereto, or to the boat structure itself. There is usually little time available for other tasks such as closing the windows, etc.

SUMMARY

The above disadvantages and drawbacks of prior window constructions are obviated by the present invention which has for an object the provision of a novel and improved quick-release fastener device especially adapted for boat windows or hatches, which is both simple in construction and capable of significantly reducing the amount of time required to open, or to close and lock a window of the type noted.

A related object of the invention is to provide an improved quick-release fastener device as above set forth, wherein the parts can be largely constituted of molded plastic, such that the manufacturing and assembly cost is kept to an absolute minimum.

Yet another object of the invention is to provide an improved quick-release fastener device of the kind indicated, which is both rugged and reliable in use over extended periods of time, and which is highly resistant to deterioration from the corrosive environment that characterizes ocean areas.

A still further object of the invention is to provide an improved quick-release fastener device in accordance with the foregoing, which can be employed with existing windows or hatches as a retro-fit, in order to replace conventional threaded knob-type fasteners currently in use, and without any modification to the existing window pane, window frame, hatch cover or tie rod structures associated therewith.

A still further object of the invention is to provide an improved quick-release fastener device as outlined above, wherein the likelihood of overtightening the parts is minimized, since the position of the manually-engageable finger piece can be preset, and the steps involving the opening and closing/locking of the window can be effected without disturbing this pre-set.

The above objects are accomplished by a unique quick-release fastener construction for securing two members together, comprising in combination a tie rod swivel mounted on one of the members, and a cross pin adapted to be carried by the tie rod. The other of the members has an abutment shoulder, and the remote end of the tie rod and its cross pin are capable of swiveling toward and away from the abutment shoulder. There is further provided a camming finger piece having bearing portions constituting a second swivel joint. The finger piece has arcuately spaced camming surfaces selectively engageable with the abutment shoulder of the other member when the members are juxtaposed. The distances of each of the camming surfaces from the cross pin's axis are different such that the finger piece can be adjustably positioned until one of its camming surfaces engages the abutment shoulder, and thereafter the finger piece turned about the cross pin so as to disengage the one camming surface from the abutment shoulder and bring the second camming surface into engagement therewith, thereby to draw the members closer together by a cam action. The difference in length from the axis of the cross pin to the cam surfaces of the finger piece represents the amount of closure distance. The length of the arc between these two points is proportional to the ease by which clamping force is applied.

The objects are further accomplished by a quick-release fastener construction for securing two members together, comprising in combination a tie rod having external threads, which is swivel mounted on one of the members, and a special nut in the form of a threaded cross bar or pin which is carried by the tie rod. The other of the members has an abutment shoulder. The special nut is adjustable on the tie rod and movable toward the abutment shoulder. Also, there is a camming finger piece having bearing portions which provide for a swivel joint between the finger piece and the nut, whereby the finger piece can swivel independently thereof. The finger piece thus has an axis of rotation on the nut, and also has arcuately spaced camming surfaces selectively engageable with the abutment shoulder of the other member when the members are juxtaposed. The distances of the camming surfaces from the axis of rotation of the finger piece about the nut are different, such that the finger piece can be adjustably positioned along the length of the tie rod by turning, until one camming surface engages the abutment shoulder, and thereafter the finger piece turned about the second swivel joint so as to disengage the one camming surface from the abutment shoulder and bring the second camming surface into engagement therewith, and thus draw the members closer together by a cam action.

The objects are still further accomplished by a boat window construction, comprising in combination a window frame including a spigot defining a window opening, a window pane having an abutment shoulder and being hingedly connected to the window frame and adapted to swing between open and closed positions, a tie rod having external threads, and means providing a first swivel joint between the tie rod and the window frame. The remote end of the tie rod is capable of swiveling toward and away from the abutment shoulder. There are provided a special nut having threads engaged with the external threads of the tie rod and adapted to be adjustably carried thereon, a camming finger piece, and bearing means on the finger piece providing a second swivel joint between the finger piece and the nut. The finger piece thus has an axis of rotation on the nut. In addition it has arcuately spaced camming surfaces selectively engageable with the abutment shoulder of the window pane when the latter is closed or nearly closed. The distances of the camming surfaces from the axis of rotation are different, such that the finger piece can be adjustably positioned along the length of the tie rod by turning, until one camming surface engages the abutment shoulder. Thereafter the finger piece can be turned about the second swivel joint so as to disengage the one camming surface from the abutment shoulder and bring the second camming surface into engagement therewith, and thus draw the window pane toward a sealing position with respect to the window frame, by a cam action.

An advantage to the construction involving a threaded tie rod is that the finger piece can be turned on the axis of the rod, and thus can be seated on the abutment in any one of four circumferentially spaced positions, each 90 degrees apart from one another. Stated differently, the finger piece can be adjustably positioned along the threaded tie rod in increments as small as one quarter of the lead of the thread of the rod while still achieving proper seating with respect to the abutment.

Other features and advantages will hereinafter appear.

In the drawings, illustrating a preferred embodiment of the invention:

FIG. 1 is a vertical section of a boat window and quick-release fastener construction as provided by the present invention, the window frame being shown mounted in a boat hull, and wherein a finger piece of the quick-release fastener is shown in a fully seated position corresponding to a closed and locked condition of the window pane.

FIG. 2 is a fragmentary vertical section of the window and fastener of FIG. 1, showing the fastener in an intermediate position during opening or closing of the window pane.

FIG. 3 is a fragmentary vertical section like that of FIG. 2, showing the fastener in a fully releasing, suspended position.

FIG. 4 is a bottom plan view of the finger piece employed in the fastener of FIGS. 1–3.

FIG. 5 is a section taken on the line 5—5 of FIG. 4.

FIG. 6 is a top plan view of the finger piece shown in FIGS. 1–5.

FIG. 7 is a section taken on the line 7—7 of FIG. 4.

FIG. 8 is a fragmentary section taken on the line 8—8 of FIG. 1, and

Figure 9:
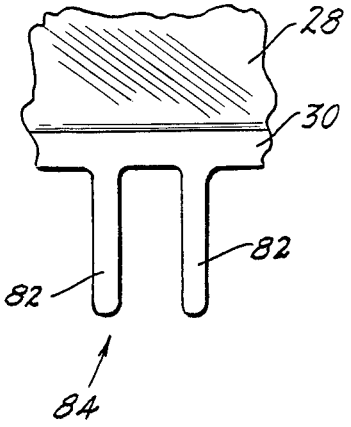
FIG. 9 is a fragmentary view looking in the direction of the arrow 9 of FIG. 3.

FIG. 1 shows in vertical section a boat window installed in the hull 10 of a boat, the window being designated generally by the numeral 12 and comprising a window frame including a mounting flange 16 and spigot 18, the latter defining a window opening 20. Wood screws (not shown) are employed to secure the flange 16 to the hull 10. A trim strip 22 on the outside of the hull 10 fits over the outer edge of the spigot 18, and is also secured by screws (not shown) or other suitable means.

The frame 16, 18 has a first hinge part 24 that is preferably integral, and is cooperable with a second hinge part 26 which carries a window pane 28. The hinge parts are connected for pivotal movement, as in the patented construction mentioned above. The pane 28 is generally flat, having a box-like peripheral stiffening flange 30. A peripheral groove 32 in the window frame receives a deformable sealing gasket 34, shown as being hollow in the figure, the gasket having an external rib that is frictionally retained in the groove 32 as shown. The gasket 34 overlies the outer edge of a window screen member 36 and holds it in position, as shown.

The screen member 36 illustrated has its upper portion open, being covered with plastic mesh 38, with the lower portion of the member being backed by a solid sheet 40 constituting a water shield.

Mounted on the window frame 16, 18 opposite the location of the hinge 24, 26 is a bearing block 42 which carries a swivel mounted tie bar or rod 44. A pivot pin 46 extends through the block 42 and tie bar 44, enabling it to swing between a suspended or freely hanging position shown in FIG. 3, and a generally horizontal position, as illustrated in FIGS. 1 and 2. Thus there exists a swivel joint between the tie bar 44 and the window frame comprising flange 16 and spigot 18. The end of the tie bar 44 that is remote from the pivot pin 46 is preferably threaded, and carries a cylindrical, bar-shaped nut 48 that takes the form of a molded plastic or cylindrical metal rod having a transverse hole or passage 50 extending through it, the passage 50 having internal threads that mate with the external threads 52 of the tie rod or bar 44.

In accordance with the present invention there is provided a novel and improved quick-release fastening device for releasably securing the window pane or member 28 to the window frame or member 16, 18, the securement or release of the fastening member being such as to greatly facilitate the opening or closing/locking of the window pane. The fastening device comprises in combination, the swivel-mounted tie bar 44 and cylindrical cross pin in the form of a nut 48 thereon, and a manually-engageable camming finger piece 54, preferably constituted as a one-piece molded plastic part. The finger piece 54 is particularly shown in FIGS. 4–7. The piece 54 has a body portion of generally U-shaped cross-sectional configuration, comprising a pair of spaced-apart, flat parallel portions 58 and a connecting yoke 62. The portions 58 have aligned circular apertures 64 with equal diameters, which provide a sliding fit with the outer diameter of the nut 48 described above. Thus there also exists swivel joint between the nut 48 and the finger piece 54.

In addition, the finger piece 54 has a bill portion 68 that lies in a plane generally tangential to the axis of the aligned apertures 64 in the portions 58 respectively. The bill portion 68 has a U-shaped recess 70, FIG. 6, with strengthening and stiffening ribs 72 along its opposite edges. The provision of the recess 70 reduces the amount of plastic material required, and provides a shallow seat for one of the fingers of the user.

On the underside of the body portion is an elongate recess 76, FIG. 4, which is intended to provide clearance space for the end of the tie rod 44 in the event that the latter extends completely through the nut 48 so as to project slightly from the opposite side thereof.

Referring again to the figures, each of the portions 58 of the finger piece 54 has a pair of camming surfaces 78, 80 respectively engageable with a cooperable amount abutment means or shoulder comprising latch prongs 82 of a fork configuration 84 of the window pane 28. Also, as shown the distances from the camming surfaces 78 and 80 to the axis of rotation of the finger piece 54 are different, the surfaces 80 being nearer the axis than the surfaces 78. The axis of rotation of the finger piece 54 is along a line extending through the centers of the apertures 64 and also along the centerline of the cylindrical nut 48. The camming surfaces 78 and 80 of the portions 58 merge with one another at arcuate slide surfaces 86, which insure a smooth movement between the camming surfaces when the finger piece 54 is manipulated and moved between the positions of FIGS. 1 and 2 respectively, as can be readily understood.

By the above arrangement, the tie rod 44 can swivel independently of the bearing block 42 and the window frame 16, 18; in addition the cylindrical nut 48 is adjustably turnable on the threaded end 52 of the tie rod 44, as well as the camming finger piece 54 being turnable about the cylindrical axis of the nut, i.e. perpendicular to the rod 44 so as to be capable of presenting either of the camming surfaces 78, 80 to the fork 84.

The operation of the improved fastening device of the present invention can now be readily understood by referring to FIGS. 1–3. FIG. 3 shows the window pane 28 open on a crack, with the tie rod 44 and finger piece 54 hanging freely suspended from the bearing block 42. The tie rod 44 normally will assume this position under the force of gravity, when the window is mounted vertically as in FIG. 1. From the position of FIG. 3 the window pane 28 can be swung upwardly toward a fully opened position (not shown). In such cases, the pane is retained in its fully open position by friction supplied by compressible washers (not shown) associated with the hinge parts 24, 26. These compressible washers are similar to those of the window construction described in the patent above identified.

When it is desired to close the window pane 28 initially, it is manually lowered to the position of FIG. 3, and thereafter the tie rod 44 and finger piece 54 are manually swung upwardly, clockwise in FIG. 3 about the pivot pin 46, so as to arrive at the relative positions of FIG. 2. In accomplishing this step, it may be necessary initially to unscrew the nut 48 and finger piece 54 to a properly adjusted position with respect to the tie rod 44, so as to clear the fork 84 on the window pane 28. From the position of FIG. 2, the finger piece 54 can be moved in the direction of the arrow in this figure, such that the parts will arrive at the relative positions shown in FIG. 1, wherein the window pane 28 and window frame or member 16, 18 are juxtaposed or in close overlying relation. Since the distances of the camming surfaces 80 from the axis of the nut 48 are less than those from the surfaces 78 to the axis, this latter step has the effect of drawing the fork 84 and window pane 28 toward the frame 16, 18 whereby the inner surface of the pane 28 engages and compresses the sealing gasket 34. In FIG. 1, the window is disposed in its fully closed, locked position.

With the arrangement just described, it can be seen that adjustment of the position of the camming finger piece 54 can be realized by rotation of the same (and the nut 48) about the axis of the tie rod 44. That is, if there results too tight a fit between the finger piece 54 and fork 84 in FIG. 1, the piece 54 can be released to the position of FIG. 2, and thereafter unscrewed (with the nut 48) from the tie rod 44 by one-half turn or so, until a satisfactory position or adjustment is achieved. Of course, once the optimal position of the finger piece 54 on the tie rod 44 is obtained, it is not necessary to re-set or readjust such position each time the window pane 28 is opened or closed. The fastening or release is then merely accomplished by a two-step operation involving swinging of the tie rod 44, and swiveling of the finger piece 54 through approximately one-quarter of a turn, or vice-versa. The clearance space provided between the two bearing portions 58 accommodates the tie rod 44 as the finger piece 54 is swiveled between the position of FIG. 1 and that of FIG. 2. This clearance space is shown in FIGS. 5 and 7, and is sufficient to permit the one-quarter turn movement of the piece, as noted above. In addition, the surfaces 78, 80 are dimensioned so that they have sufficient length to permit turning of the finger piece 54 about the axis of the tie rod, while still remaining seated against the fork 84. Thus the position of the finger piece 54 on the tie rod can be set to virtually any degree of precision or resolution, assuring the user of satisfactory operation, and maintaining the integrity of the window seal.

With such an arrangement a substantial saving of time is realizeable, as compared with that required in securing prior fasteners. Typically, a fastener such as that illustrated and described in the U.S. Patent identified above involves between 15 and 30 seconds to manipulate, depending on the dexterity of the user. With the present arrangement, a similar function involving either opening or closing/locking of the window pane 28 can take less than 5 seconds. As mentioned above, where a dozen or more such windows are employed in a particular vessel or craft, each window having typically two or three fasteners, the improvement in ease of operation that is represented by the present construction is significant.

Also, with the device of the present invention there is minimized the possibility of inadvertent breakage of the plastic parts associated with the window, namely the fork 84 and the hinge block 42. This was sometimes a problem in prior constructions where manual overtightening of a securement knob could crack the window, thus necessitating complete replacement.

From the above it can be seen that I have provided a novel and improved fastening device especially suited for boat windows, the unit being simple in construction and reliable in operation. It significantly reduces the time required to open or to close/lock multiple window units, without sacrifice of the integrity of the window lock feature, and without loss of an effective seal. It has been found that with the particular thread pitch typically employed on the tie rod threads, adjustment of the rotary position of the finger piece 54 in one-half turn increments will permit more than adequate resolution to achieve smooth, jam-free operation while still permitting the seal between the gasket and window pane to remain adequately tight.

The device is thus seen to represent a distinct advance and improvement in the field of quick-release fasteners, especially as applied to use with boat windows.

Each and every one of the appended claims defines an aspect of the invention which is separate and distinct from all others, and accordingly each claim is to be treated in this manner when examined in the light of the prior art devices in any determination of novelty or validity.

Variations and modifications are possible without departing from the spirit of the invention.

What is claimed is:

1. A quick-release fastener construction, comprising in combination:
(a) two members capable of relative movement,
(b) a tie rod having external threads,
(c) means providing a first swivel joint between said tie rod and one of said members,
(d) the other of said members having an abutment shoulder, the remote end of said tie rod being capable of swiveling toward and away from said abutment shoulder,
(e) a nut having threads engaged with the external threads of the tie rod and adapted to be carried on the latter,
(f) a camming finger piece, and bearing means providing a second swivel joint between the said finger piece and said nut, whereby the nut can be turnably adjusted on the tie rod and the finger piece can swievel independently of the nut,
(g) said finger piece having an axis of rotation on said nut, and having a pair of arcuately spaced camming surfaces selectively engageable with the abutment shoulder of the said other member when the members are juxtaposed, the distances of said camming surfaces from the said axis of rotation being different, said finger piece being adjustably positionable along the length of the tie rod by turning it about the axis thereof until one camming surface can engage the said abutment shoulder, and thereafter the finger piece being turnable about the second swivel joint so as to disengage said one camming surface from the abutment shoulder and bring the second camming surface into engagement with the said abutment shoulder, thereby to draw the members closer together by a cam action.

2. The invention as set forth in claim 1, wherein:
(a) said finger piece has a bill portion disposed in a plane that is tangential to the axis of rotation thereof.

3. The invention as set forth in claim 1, wherein:
(a) said tie rod can be manually swung between a first position adjacent the abutment shoulder of said other member when the members are juxtaposed, and a second position remote from said abutment shoulder and other member.

4. The invention as set forth in claim 3, wherein:
(a) said members are disposed vertically, in side-by-side relation,
(b) said tie rod assuming said second position remote from the abutment shoulder, by virtue of the force of gravity.

5. The invention as set forth in claim 1, wherein:
(a) said spaced camming surfaces are merged with an arcuate connecting surface to facilitate turning of the finger piece about the said second swivel joint while the finger piece is in engagement with said abutment shoulder.

6. The invention as set forth in claim 1, wherein:
(a) said nut comprises an essentially cylindrical pin having a threaded, transverse passage, said finger piece having spaced apart cylindrical bearing surfaces of a size to slidably receive said pin and engage the same on opposite sides of said transverse passage,
(b) said bearing surfaces and the surface of said pin constituting the said second swivel joint.

7. The invention as set forth in claim 1, wherein:
(a) said camming finger piece has a recess adjacent the location of the nut, to provide clearance for the end of the tie rod if the nut is screwed down past a certain point, so as to prevent inadvertent damage to the parts.

8. The invention as set forth in claim 1, wherein:
(a) said abutment shoulder comprises a projection on said other member,
(b) said abutment shoulder being adapted to overlie the first swivel joint between the tie rod and said one member when the members are juxtaposed.

9. The invention as set forth in claim 2, wherein:
(a) said bill portion is elongate, and has a strengthening and stiffening rib for a portion of its length.

10. The invention as set forth in claim 1, wherein:
(a) said nut is constituted of plastic, and its threads are molded integral with the remainder thereof.

11. The invention as set forth in claim 1, wherein:
(a) said camming finger piece is constituted of plastic, and all parts thereof are molded integral with one another.

12. The invention as set forth in claim 1, wherein:
(a) said camming finger piece has a U-shaped cross-sectional configuration, comprising a pair of spaced bearing portions and a connecting yoke.

13. The invention as set forth in claim 12, wherein:
(a) said bearing portions have aligned apertures constituting bearings of the second swivel joint,
(b) said nut comprising a pin receivable in said apertures, and being rotatable therein,
(c) said pin having a transverse passage with internal threads to receive the threads of the tie rod.

14. The invention as set forth in claim 12, wherein:
(a) said bearing portions and connecting yoke constitute means defining a clearance space for the tie rod as the finger piece is turned about its axis of rotation on the nut.

15. The invention as set forth in claim 1, wherein:
(a) said first swivel joint comprises means defining an apertured bearing block on said one member,
(b) means defining an aperture in said tie rod, and
(c) a pivot pin extending through the apertures of the bearing block and the tie rod.

16. A quick-release fastener construction, comprising in combination:
(a) two members capable of relative movement,
(b) a tie rod having external threads,
(c) means providing a connection between said tie rod and one of said members,
(d) the other of said members having an abutment shoulder, movable toward and away from said tie rod,
(e) a nut having internal threads engaged with the external threads of the tie rod and adapted to be carried on the latter, (f) a camming finger piece, and bearing means providing a swivel joint between the said finger piece and the nut, whereby said nut can be turnably adjusted on the tie rod and the finger piece can swivel independently of the nut, (g) said finger piece having an axis of rotation on said nut, and having a pair of arcuately spaced camming surfaces selectively engageable with the abutment shoulder of the said other member when the members are juxtaposed, the distances of said camming surfaces from the said axis of rotation being different such that when the finger piece is adjustably positioned along the length of the tie rod by turning it about the axis thereof unitl one camming surface engages the said abutment shoulder, and thereafter turned about its own axis so as to disengage engage said one camming surface from the abutment shoulder and bring the second camming surface into engagement with the said abutment shoulder, it can thereby draw the members closer together by a cam action.

17. A boat window construction, comprising in combination:

(a) a window frame including a spigot defining a window opening, (b) a window pane hingedly connected to the window frame and adapted to swing between open and closed positions, (c) a tie rod having external threads, (d) means providing a first swivel joint between said tie rod and said window frame, (e) said window pane having an abutment shoulder, the remote end of said tie rod being capable of swiveling toward and away from said abutment shoulder when the window pane is disposed in its closed position, (f) a nut having threads engaged with the external threads of the tie rod and adapted to be carried on the latter, (g) a camming finger piece, and bearing means providing a second swivel joint between the said finger piece and said nut, whereby the nut can be turnably adjusted on the tie rod and the finger piece can swivel independently of the nut, (h) said finger piece having an axis of rotation on said nut, and having a pair of arcuately spaced camming surfaces selectively engageable with the abutment shoulder of the said window pane when the latter is closed, the distances of said camming surfaces from the said axis of rotation being different, said finger piece being adjustably positionable along the length of the tie rod by turning it and the nut about the axis thereof until one camming surface can engage the said abutment shoulder, and thereafter the finger piece being turnable about its own axis so as to disengage said one camming surface from the abutment shoulder and bring the second camming surface into engagement with the said abutment shoulder, thereby to draw the window pane toward a sealing position with respect to the window frame, by a cam action.

18. The invention as set forth in claim 1, wherein:

(a) said camming finger piece has a U-shaped cross-sectional configuration, comprising a pair of bearing portions and a connecting yoke, (b) said pair of camming surfaces being disposed on one of said bearing portions, (c) the other of said bearing portions having a complementary pair of arcuately spaced camming surfaces disposed in spaced apart, side-by-side relation with respect to the first pair, (d) said abutment shoulder of the other member comprising a fork having two prongs, the area between the prongs constituting a clearance space to enable the tie rod to be received therebetween, when the members are juxtaposed, (e) one of said prongs being engageable by said first-mentioned pair of arcuately spaced camming surfaces, and the other of said prongs being engageable by the complementary pair of arcuately spaced camming surfaces as the finger piece is turned about its axis of rotation while the members are juxtaposed.

19. The invention as set forth in claim 18, wherein:

(a) said bearing portions define therebetween a clearance space to accommodate the tie rod as the finger piece is turned.

20. The invention as set forth in claim 18, wherein:

(a) the lengths of the prongs and the lengths of the camming surfaces are sufficient to enable turning of the finger piece about the tie rod while maintaining engagement between at least limited portions of the prongs and the camming surfaces.

21. A quick-release fastener construction, comprising in combination:

(a) two members capable of relative movement, (b) a tie rod, (c) means providing a swivel connection between said tie rod and one of said members, (d) the other of said members having an abutment shoulder, moveable toward and away from said tie rod, (e) a cross pin adjustably threaded on the tie rod, (f) a camming finger piece, and bearing means providing a swivel joint betwen the said finger piece and the cross pin, whereby said finger piece can swivel independently of the cross pin and tie rod, (g) said finger piece having an axis of rotation on said cross pin, and having a pair of arcuately spaced camming surfaces selectively engageable with the abutment shoulder of the said other member when the members are juxtaposed, the distances of said camming surfaces from the axis of the cross pin being different such that the finger piece can be adjustably positioned wherein one camming surface engages the said abutment shoulder, and thereafter turned about the axis of the cross pion so as to disengage said one camming surface from the abutment shoulder and bring the second camming surface into engagement with the said abutment shoulder, and thereby draw the members closer together by a cam action.

* * * * *